299-13
10/28/80 XR 4,230,368 SR

United States Patent [19]
Cleary, Jr.

[11] 4,230,368
[45] Oct. 28, 1980

[54] METHOD FOR DISPLACING LARGE BLOCKS OF EARTH

[76] Inventor: James M. Cleary, Jr., 92 McCallum Dr. - Box 541, Falmouth, Mass. 02541

[21] Appl. No.: 11,631

[22] Filed: Feb. 12, 1979

[51] Int. Cl.[3] ..... E21C 41/04; E21C 41/12
[52] U.S. Cl. ..... 299/2; 299/13; 299/18; 299/19; 166/259; 166/280; 166/308; 405/55; 405/266
[58] Field of Search ..... 299/10-12, 299/18, 19, 2, 13, 15, 16; 175/19; 405/55-58, 303, 258, 266-269; 166/308, 280, 259; 37/3, 195; 102/23

[56] References Cited

U.S. PATENT DOCUMENTS

| | | | |
|---|---|---|---|
| 703,302 | 6/1902 | Pratt | 299/13 |
| 1,915,032 | 6/1933 | Poulter | 405/266 |
| 2,104,579 | 1/1938 | Bennett | 299/16 |
| 2,547,778 | 4/1951 | Reistle | 405/57 |
| 2,757,514 | 8/1956 | Wyatt | 405/266 X |
| 3,220,475 | 11/1965 | Brandon | 166/308 X |
| 3,220,476 | 11/1965 | Brandon | 166/249 |
| 3,303,881 | 2/1967 | Dixon | 166/249 X |
| 3,776,594 | 12/1973 | Haspert | 299/18 |
| 3,874,733 | 8/1973 | Poundstone et al. | 299/18 X |
| 3,917,349 | 4/1974 | Cleary | 299/13 |
| 4,037,657 | 7/1977 | Lekas | 166/259 X |
| 4,175,490 | 11/1979 | Britton et al. | 299/2 X |

*Primary Examiner*—Ernest R. Purser

[57] ABSTRACT

A method for elevating extremely large blocks of earth by displacement with a slurry composed of water and locally excavated materials. The blocks are separated on lateral faces by variously drilling, jetting, fracturing, and kerf cutting operations. The blocks are separated at the lower end by notching and hydraulic fracturing. Block movement is started by injecting gelled fluid into the narrow separations.

In one set of applications the high density slurry filling the side clearances is less dense than the block being elevated. In these cases the earth blocks are displaced upward by injecting fluid into the underside, and the non hydrostatic component of the displacement pressure is contained by the gel strength of the slurry filling the narrow side clearance. In a second set of applications the blocks being elevated contain a high percentage of coal, and slurry filling the side clearances exceeds the block density. The blocks are then displaced upward by hydrostatic pressure. The method has a wide range of applications which include elevating a block and cementing it in place to form a storage cavity, elevating a block and fragmenting a hydrocarbon containing section into the resulting cavity in preparation for in situ recovery of hydrocarbons, and elevating a block to recover the coal contained in the block.

28 Claims, 20 Drawing Figures

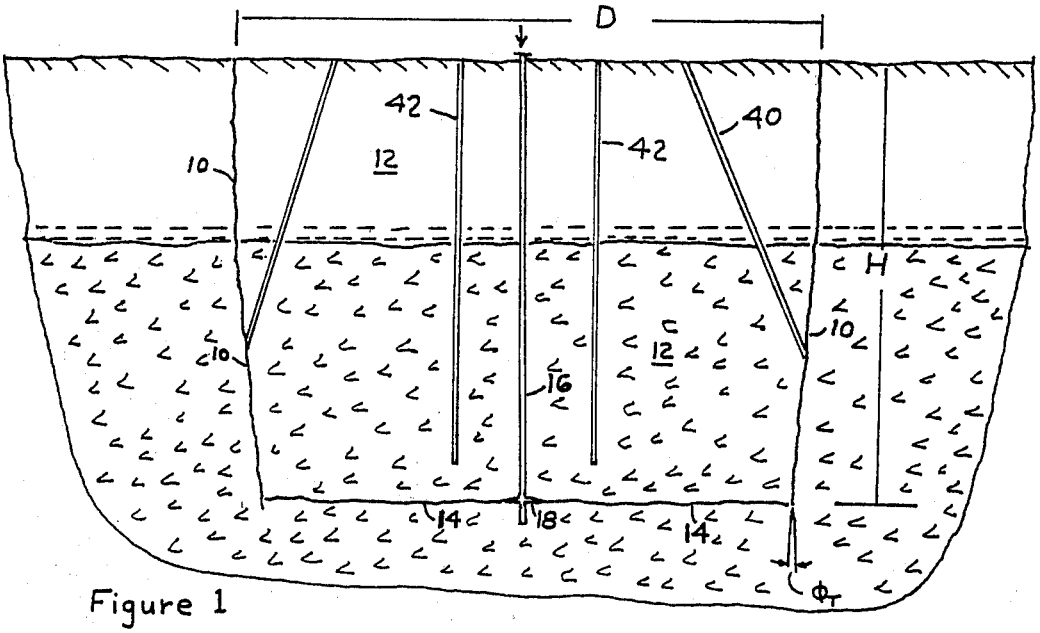
Figure 1
Figure 2
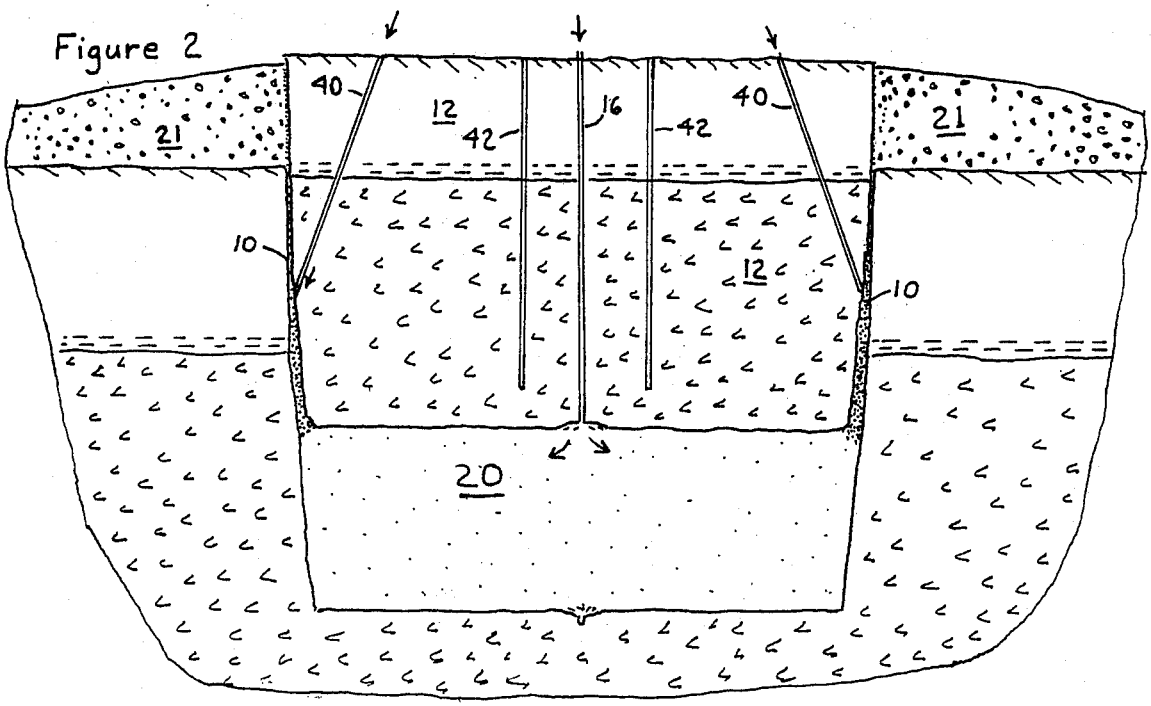

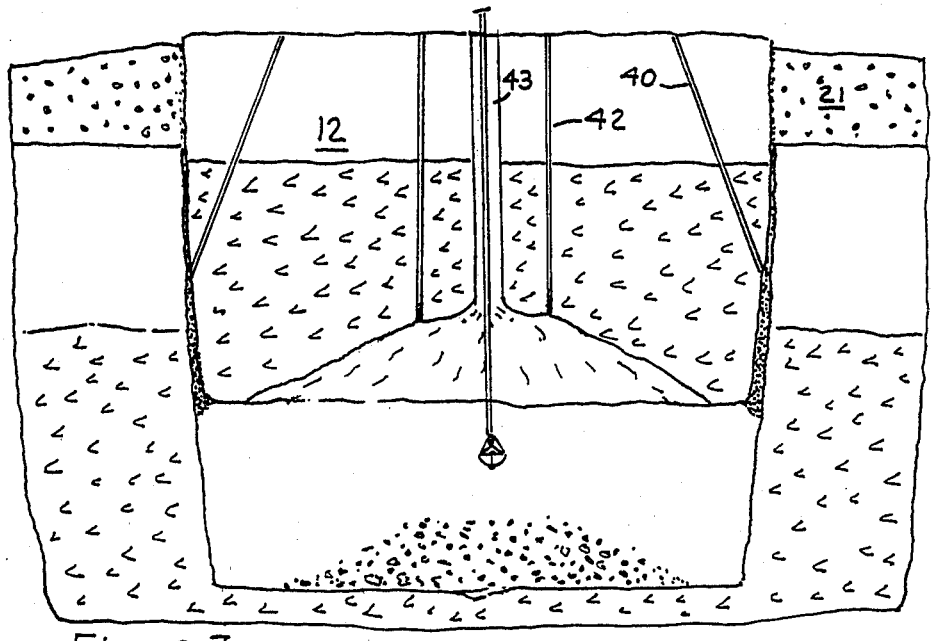
Figure 7
Figure 8
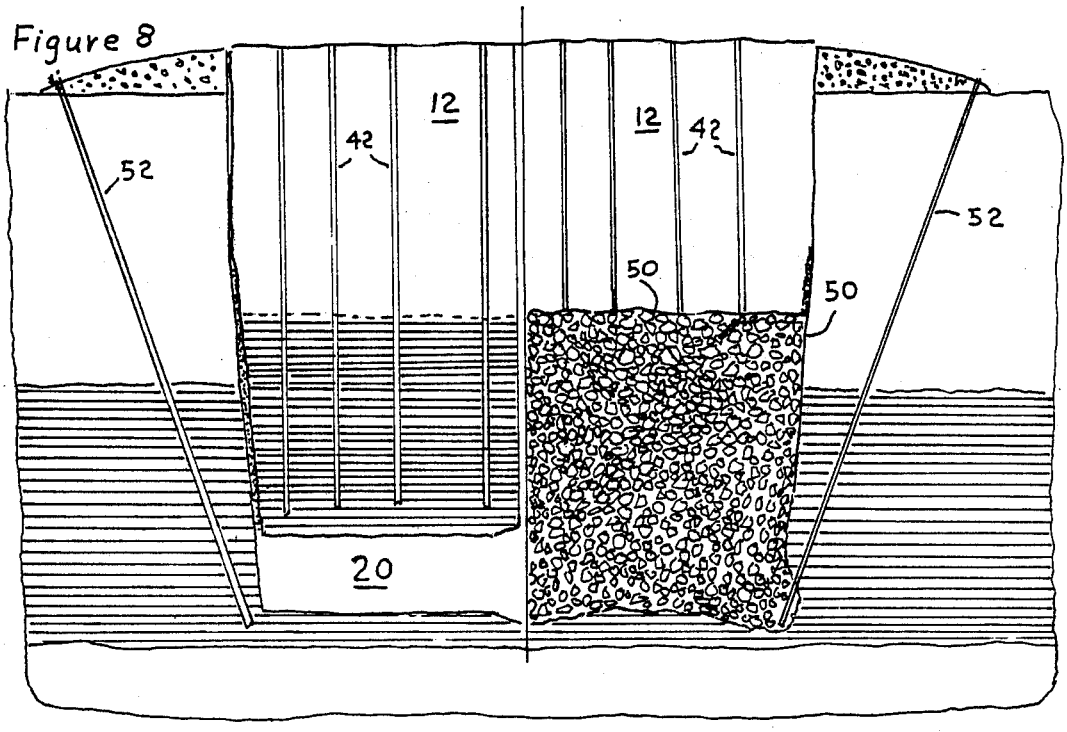

Figure 9
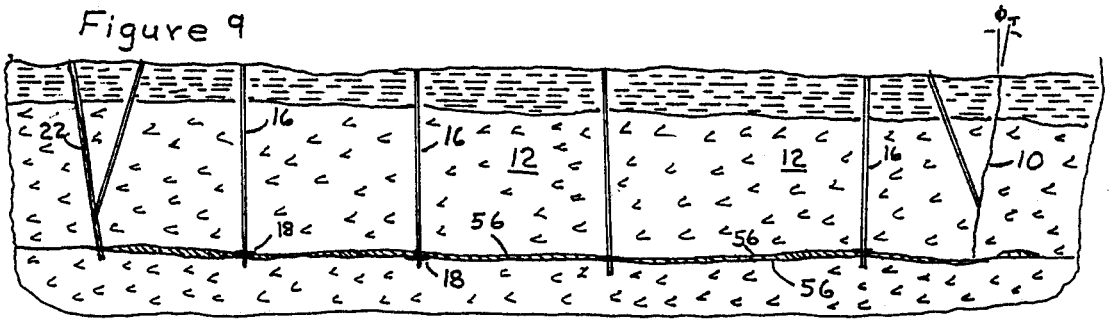
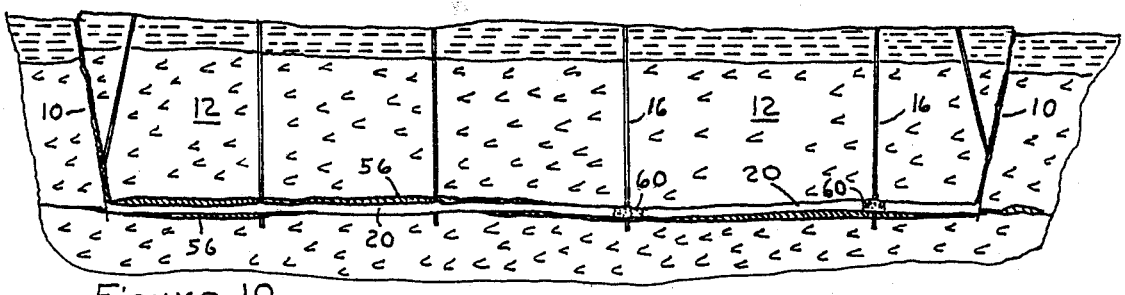
Figure 10
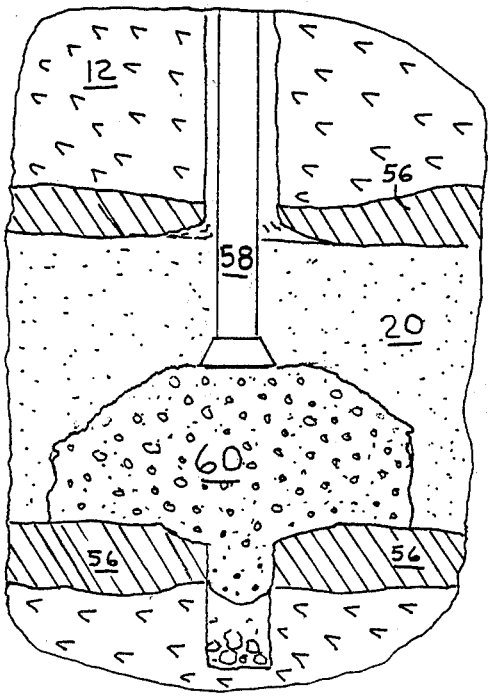
Figure 11
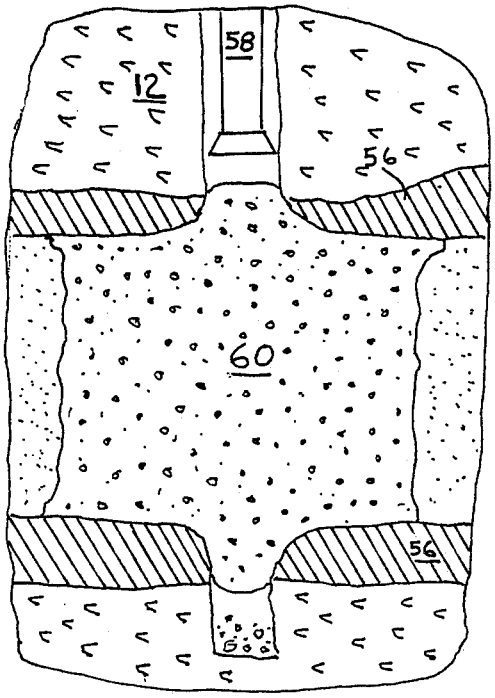
Figure 12

METHOD FOR DISPLACING LARGE BLOCKS OF EARTH

BACKGROUND OF THE INVENTION

This invention provides a method for elevating very large blocks of earth. The method may be applied in the creation of underground storage cavities, mining, and in situ hydrocarbon recovery.

A slurry mixed from locally excavated materials including a substantial percentage of clay is used to stabilize underground openings associated with the process. The use of clay slurry to stabilize underground openings has been widely practiced for many years both in rotary drilling and in construction. The use of slurry to stabilize a deep trench during its excavation is described in U.S. Pat. No. 2,757,514. A very similar method of excavation in a slurry filled trench is disclosed in U.S. Pat. No. 3,776,594 for the recovery of mineral from a steeply pitching vein, B. C. Gerwick, *Civil Engineering* ASCE, Dec. 1967 p. 70–72, reviews the use of slurry in stabilizing deep excavations for foundations and the like.

The present invention employs hydraulic fracture propagation for separating rock masses. Such an application for quarrying rock masses is disclosed in U.S. Pat. No. 703,302. The present invention makes novel use of a gelled slurry as a working fluid to displace extremely large blocks of earth materials. In this respect the invention is similar to a preferred embodiment of the mining method disclosed in U.S. Pat. No. 3,917,349 where massive blocks of coal overburden are displaced in a substantially horizontal direction by hydrostatic slurry pressure. The present invention is distinguished from the above embodiment of U.S. Pat. No. 3,917,349 in that the blocks of earth are displaced either vertically or steeply upward by fluid pressure. The present invention has a wide range of applications. One object is to provide an economical method for creating a deep underground cavity. The cavity may then be used for storage of liquids, or in another group of applications the cavity may provide the void needed for fragmenting coal or oil shale in preparation for the in situ recovery of hydrocarbons. In the past such preparations have been made by such methods as detonating explosives in bore holes and in hydraulic fractures. These methods have not proven satisfactory because a major portion of the deposits within the intended recovery area are not fragmented to sufficient porosity and permeability so that injected reactants fail to contact major portions of the resource, which is then by-passed and not recovered. Expensive but physically more efficient methods of preparing oil shale for in situ recovery have been proposed. By these methods openings are mined out of the shale and adjacent shale is blasted or stoped into the openings. Such proposals are made in U.S. Pat. No. 3,001,776 and 3,316,020 and 3,434,757. The resulting oil shale filled cavities are then operated as retorts. The shale is heated by partial combustion with injected air. The resulting heat of combustion distills out the oil which is drawn from wells connected to the bottom of the retort. It is an object of the present invention to provide a more economical method for producing such underground retorts filled with fragmented coal or oil shale while avoiding the expense of deep underground mining.

In yet another group of applications, the present invention is used to elevate massive sections of coal bed for recovery at the surface. In these cases the present invention provides economical alternatives to conventional mining.

In the past, recovery of coal from steeply dipping beds has often been by surface mining. This method has limited practical depth of application because the volume of overburden moved and surface area disturbed increase rapidly with depth. Mechanized underground mining of steeply dipping seams involves major problems with movement and operation of equipment and with miner safety. Accordingly, it is an object of the present invention to provide an economical method for recovery of coal to substantial depths from steeply dipping beds, that minimizes surface disturbance, and allows operators to remain at the surface. U.S. Pat. No. 3,874,733 and U.S. Pat. No. 3,776,594 disclose mining techniques for recovering coal from a nearly vertical seam where a dense slurry fills the mine cavity and serves to float fragmented coal to the surface of the cavity. The coal is then separated from the slurry and the slurry is reused. The slurry used in such a mining system must contain a high percentage of expensive weighting material such as fine iron ore. The special weighting material is needed so that the required slurry density is compatible with the other qualities needed for efficient flotation and separation of fragmented coal. For this use of such weighted slurry to be economical, loss of expensive weighting material in the mined out cavity must be kept small. But since very large volumes of slurry are required to fill the mine cavity it is very difficult to prevent excessive loss of weighting material.

When the present invention is employed to recover massive blocks of coal, these difficulties are avoided. The dense slurry used with the present invention is mixed from common earth materials excavated locally and is so inexpensive that it is economical to expend large quantities during the mining operation. This slurry is unsuitable for use in flotation and subsequent separation of fragmented coal, as proposed in U.S. Pat. Nos. 3,874,733 and 3,776,594, because of its high gel strength, viscosity, and solids content, but these qualities do not impede its use in the present invention because the large blocks of coal recovered are easily washed free of contaminating slurry.

SUMMARY OF THE INVENTION

This invention describes a method for moving a massive block of earth materials upward by fluid displacement. Objectives of the block moving method include recovery of coal contained in the elevated block, or the formation of a cavity under the elevated block. The cavity may then be used to store liquids or gasses, or to prepare a mineral deposit for in situ recovery by fragmenting the deposit into the cavity with explosives. In these various applications the present invention provides an economical alternative to underground excavation and, in certain cases, an alternative to conventional strip mining.

The block to be elevated is separated down the sides by various methods such as drilling, hydraulic jetting, and fracturing. The separations down the sides are normally formed so that the block tapers downward. The separations at the sides of the block are filled with dense slurry which stabilizes the block and surrounding materials. The dense slurry is mixed from locally excavated earth solids including a substantial percentage of clay and sand.

Fractures are extended across the lower end of the block by fluid injection into bore hole notches or by the discharge of explosives.

Details of the block elevating process depend on the intended application. In many applications the block density exceeds the density of the slurry that fills the separations at the sides. In these cases the unbuoyed weight of the block is overcome by maintaining relatively small clearances at the sides and relying on the high gel strength of slurry filling the side clearances to resist the nonhydrostatic component of displacement pressure as the block is displaced upward by pumping fluid into the underside through injection wells. When the objective in elevating the block is to form an underground cavity, the separations at the sides are injected with concrete to hold the block in place after its displacement.

If the upward displacement is substantial it will frequently be an advantage to excavate materials from the top of the block during its displacement and compact these materials around the sides. This procedure helps contain the required displacement pressure.

The present invention can be applied to recover massive blocks of coal from steeply dipping beds. The first step in this application is to bore an opening which extends across the thickness of the coal bed and reaches from the surface down the dip to the maximum recovery depth planned for the operation. The opening is filled with slurry having greater density than the columnar blocks of coal to be separated, moved up dip, and recovered. The operation advances along the strike as a series of columnar coal blocks are moved toward the surface, broken, and loaded.

A coal block is separated down the sides parallel to the bedding and one side facing away from the mined out cavity by rotary drilling down dip parallel to the bedding, by hydraulic jetting, by fracturing, or by other kerf cutting methods that may be available. The lower end of the block is fractured through by injection of fluid into oriented notches or by discharge of explosives. At least one of the separations parallel to the bedding must provide appreciable clearance for block movement. The two sides parallel to the bedding must either have nearly constant spacing or be slightly convergent downward. Final separation of a block may be effected by combinations of injection of fluid into the separations and discharge of explosives at the bottom end. After its release, the coal block slides up dip under the buoyancy force. Coal is broken, loaded, and hauled from the upper end as it emerges.

In this application for recovery coal from steeply dipping beds, the slurry density required to support the hanging wall side of the mine opening increases as the dip decreases. Dips less than 35° may exceed the practical limit for application of the process and the range of application is preferably between 40° and 90°.

BRIEF DESCRIPTION OF FIGURES

FIG. 1 is a cross sectional view of an earth block to be elevated by fluid displacement;

FIG. 2 is a cross sectional view of an earth block after displacement by injected fluid;

FIG. 7 is a cross section through a storage cavity with the roof reshaped to improve stability.

FIG. 8 shows cross sections before and after fragmentation of oil shale into cavity;

FIG. 9 is a cross section through an earth block prepared for elevation to provide access to a thin horizontal mineral vein;

FIG. 10 is a cross section showing block elevated to provide access to mineral deposit.

FIG. 11 is a cross section showing a process for pumping concrete support pillar into place;

FIG. 12 is a cross section showing completed 'pumped in' support pillar;

DESCRIPTION OF PREFERRED EMBODIMENTS

Figure 3:
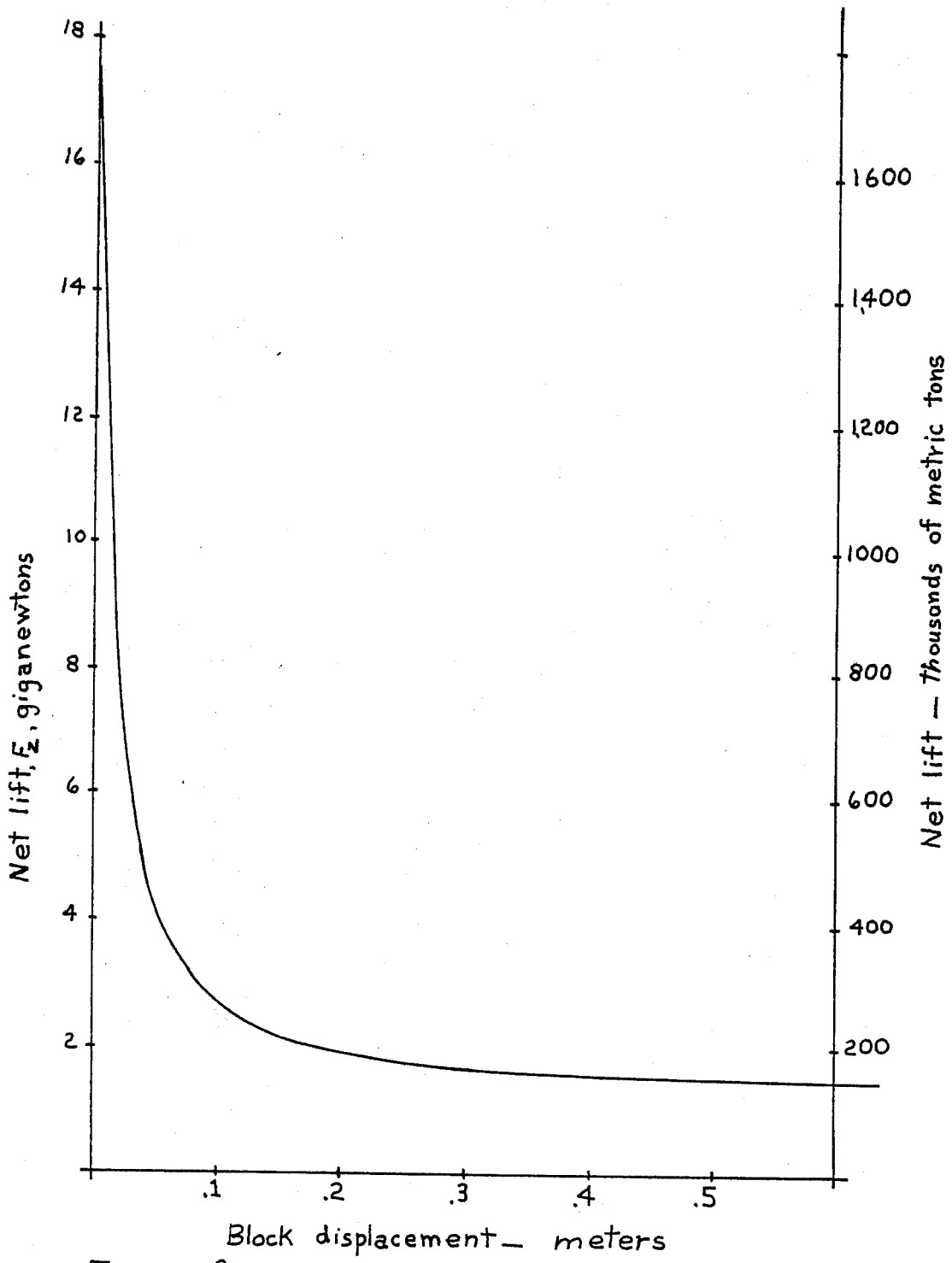
FIG. 3 is a plot of the 'net available displacement force' due to gelled fluid injection vs. block displacement.

FIGS. 1 and 2 illustrate the main features of the present invention as it applies to the formation of a cavity. Vertical or steeply storing separations 10 are created by various processes such as drilling, hydraulic jetting, fracturing, or specialized kerf cutting techniques. Separations 10 delineate the sides of a massive earth block 12. The lower end of 12 is separated from materials below by fracture 14. Basal separation fracture 14 is formed by extending hydraulic fractures from one or more notched holes 16. The notches 18 used to direct fracture 14 may be cut by high velocity water jets.

Fracture 14 is extended across the lower end of 12 by injection of fluid through one or more injection wells 16. The fluid first injected is preferably water containing a small percentage of material which controls fluid loss through permeable rock surfaces. Such fluid loss control agents are used in drilling muds and hydraulic fracturing fluids. Such materials include guar gum, CMC (carboxymethyl celulose), modified starch, and sodium bentonite. As injection continues, the gel strength of injected fluid is progressively increased by additions of polymer or clay. The gelled water flows from 14 up into 10. The density and gel strength of injected fluid continues to be increased by adding a high percentage of mineral solids including clay, silt, and sand. When the gel strength of fluid filling 10 is high enough, the block is displaced upward by fluid injection as shown in FIG. 2. The basal fracture 14 is transformed by block movement into cavity 20.

Lift force: The lift force on 12 is, in major part, a buoyance force due to the weight of the fluid column in 10. But the density of slurry filling 10, generally in the range 1,700 to 2,100 kg/m$^3$, is usually significantly less than the average density of 12. The unbuoyed weight of 12 plus frictional drag must then be overcome by a nonhydrostatic component of pressure at the underside of 12. This nonhydrostatic pressure component owes its existence to the 'threshold' flow resistance of the gelled slurry.

The gel strength of the slurry is generally greater than 40 Pa and may be increased to as high a level as may be required by increasing the clay content and decreasing the water content. The flow behavior of such dense slurry mixtures approximates that of a Bingham plastic where a certain shear stress (the gel strength) must be exceeded for any flow to occur. Above this threshold shearing stress, $\tau$, the shear stress increases in proportion to the shear rate like a viscous liquid. However, in the present application the shear rates are generally so low that the viscous component of shear stress in the separations can be neglected.

The threshold flow gradient for a gelled fluid in a slot is obtained by adding the forces on a fluid element in the direction of movement, when the velocity is so low that the boundary shear stress is approximately equal to the gel strength, $\tau$.

Figure 19:
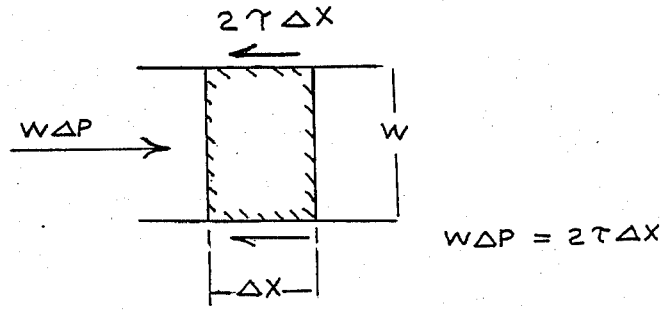
FIG. 19 shows the force increments in the flow direction on an element of gelled fluid moving in a slot.

FIG. 19 shows the equilibrium of forces acting on a gelled fluid element moving slowly in a slot. The length of the element in the direction of movement is $\Delta x$. The width of the slot is W. The shear stress at the boundary equals the gel strength, $\tau$. The pressure drop across the element is $\Delta P$, then $$w\,\Delta P = 2\tau x \text{ or } \Delta P/\Delta x = 2\tau/w \tag{1}$$

Consider, as an example, a cylindrical block of earth materials whose diameter is D, height H, and whose effective side clearance width is d. Let the width of the lower separation due to block displacement be Z.

If a fluid of gel strength, $\tau$, is injected into the underside of the block at the center, the resistance to radial flow in the bottom clearance results in a conical pressure distribution across the bottom face of the block.

Figure 20:
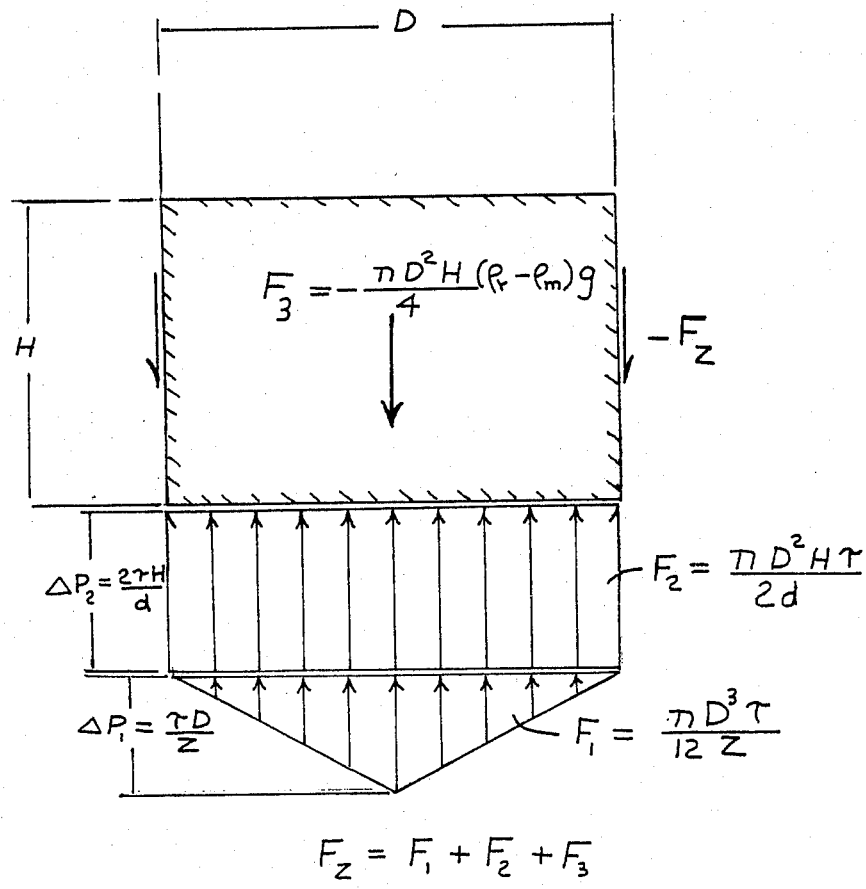
FIG. 20 shows the vertical force component on a cylindrical earth mass during injection of gelled fluid into its underside.

See FIG. 20 which shows the pressure component at the underside of the block due to flow friction and the vertical force components.

The pressure drop from the point of injection to the perimeter of the bottom clearance is, according to (1), letting Z=W, and $\Delta x = D/2$, $$\Delta P_1 = \tau D/Z \tag{2.1}$$

The pressure drop up the sides of the block due to threshold flow resistance is, according to (1), letting Z=d, $$\Delta P_2 = 2\tau H/d \tag{2.2}$$

The lift force against the bottom surface of the block due to these flow resistances has two components. The component due to $\Delta P_1$ results from the cone shaped pressure distribution across the bottom face of the block. This force, $F_1$, is $$F_1 = \eta D^2/4[\Delta P_1/3] = \eta D^3\tau/12Z \tag{3.1}$$

The lift force component due to $\Delta P_2$ is $$F_2 = \eta D^2 H\tau/2d \tag{3.2}$$

The lift force is resisted by the unbuoyed weight of the block. The weight of the block minus the buoyancy force is given by $$F_3 = -\eta D^2 H\,(\rho_r - \rho_m)g \tag{3.3}$$

where $\rho_r$ is the average rock density and $\rho_m$ is the density of mud slurry filling the side clearance. The net lift force component, $F_z$, available for overcoming friction is then the sum ($F_1 = F_2 = F_3$) or $$F_z = \eta D^3\tau/12Z + \eta D^2 H\tau/2d - \eta D^2 H(\rho_r - \rho_m)g \tag{4}$$

Flow friction on the lower clearance makes available an extremely large initial lift force when it is most needed to start block displacement. The net lift force $F_z$ is extremely large when the block displacement is small because the component $F_1$ is large when flow resistance in the lower clearance is large. When the displacement of the block is less than about 3 centimeters, the value of Z used in equation (3) must be corrected for the elastic deformation of materials adjacent the lower separation. If this correction is not made, equation (3) overestimates the lift force for very small displacements.

The force component, $F_z$, is termed the net available lift force. It is the force in excess of the weight of the block available for overcoming friction. It should be emphasized that the net available force, $F_z$, is generated only if a corresponding friction drag exists in the annular clearance.

As a specific example, the value of $F_z$ is plotted vs. block displacement, Z, in FIG. 3, assuming the following conditions:

D=114 m, H=100 m, d=0.2 m, $\tau$=400 Pa, $\rho_r$=2300 kg/m$^3$, $\rho_m$=2000 kg/m$^3$.

FIG. 3 shows that the available force, $F_z$, decreases rapidly at first as the component due to flow friction across the base of 12 becomes negligible. However, $F_z$ continues to be very large after substantial block displacement.

Minimum gel strength under ideal conditions: Ideally the block would be delineated by cutting a narrow vertical kerf of uniform width to completely free the sides of the block. With such an ideal annular clearance, the friction against the sides of the block would approximately equal the product of the fluid gel strength and the annular area. This annular friction is very small in comparison with the available hydraulic lift force. Under such ideal conditions the expression for the minimum gel strength of fluid filling the annular clearance required to continue lifting the block after a short initial displacement is obtained from (4) by setting $F_z$ equal to zero, giving $$\tau_{min} = d/2(\rho_r - \rho_m)g \tag{5}$$

Separation 10 would generally be formed at a small angle $\phi_t$, from vertical so that 12 tapers downward at least slightly. Thus as 12 moves upward, the radial clearance, d, increases, areas of heavily loaded dragging contact are eliminated, and sliding friction becomes negligible. The gel strength of fluid filling 10 required to raise the block is then given by (5). With a tapered block the annular clearance d becomes a function of displacement z.

$$d = z \tan \phi_T = d_o \quad (6)$$

where $d_o$ is the initial clearance.

As the upper end of the block rises significantly above ground level, fill from the top of 12 is preferably compacted as a ramp 21 against the emerging sides of 12. In this way the fluid head in 10 is kept equal to the height of the block and the clearance, d, in this section can be kept smaller than the value given by (6), thus, reducing the gel strength and density requirement.

Methods for creating separation 10: Various conventional and unconventional kerf cutting methods might be used to create separation 10. However, most kerf cutting techniques in current practice would be very expensive to use in creating 10. One method that may be economical in certain applications is to drill a line of holes and connect the holes by hydraulic jetting. This method would generally require simultaneous bailing of the hole by air circulation to allow the high pressure water jets to operate in an air atmosphere. Jet attenuation would, thus, be minimized, allowing the jets to cut to substantial depth.

Figure 4:
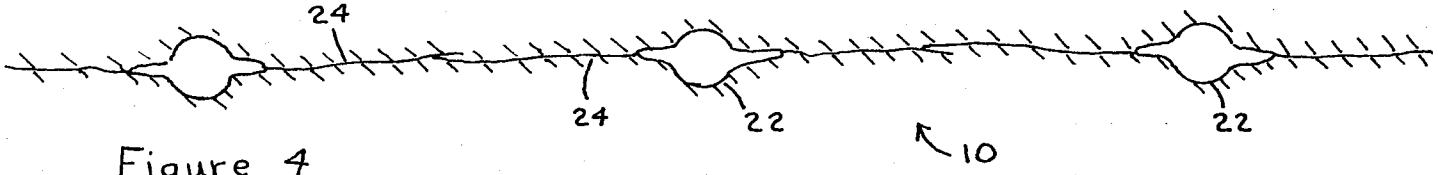
FIG. 4 is a horizontal cross section through a lateral block separation formed by fracturing between notched drill holes.

Both drilling and hydraulic jetting are expensive, and it may be prohibitively expensive to jet deep notches in hard rock. Therefore, there is a major economic incentive to create separation 10 primarily by fracturing. This practice would allow the drilling and hydraulic jetting expense to be minimized by using a relatively wide hole spacing. FIG. 4 illustrates this method of creating 10. The holes 22 are notched in order to direct the extension of fractures 24 so as to connect the holes. The fractures are propagated by filling the holes with water containing fluid loss control agent and detonating line charges of explosive over the lengths of the holes. The water used to fill holes 22 preferably contains a small concentration (<1%) of organic polymer capable of forming very low permeability filter cake on permeable rock surfaces.

After fractures have been propagated between holes 22 to form separation 10 it will frequently be an advantage to fill holes 22 with a slurry capable of developing substantial shear strength. This slurry may be composed of clay, silt, sand, and a small precentage of cement mixed with water. It is designed to develop a shear strength between 10 and 20 kPa. Holes 22 are thus blocked by the slurry in order to develop higher lift pressure when fluid is injected into the underside of 12.

The disadvantage of fractures as a means of separating block 12 from surrounding materials is that fractures are rough and interlocking and do not provide clearance. When a rough tensile fracture is propagated through rock and one fracture face is sheared past the other, asperities on opposing surfaces override one another forcing the surfaces apart. Shear displacement is accompanied by crushing and deformation of steep sided asperities. The relative motion between two such rough surfaces in sliding contact is represented by the 'dilation curve' in FIG. 5.

Figure 5:
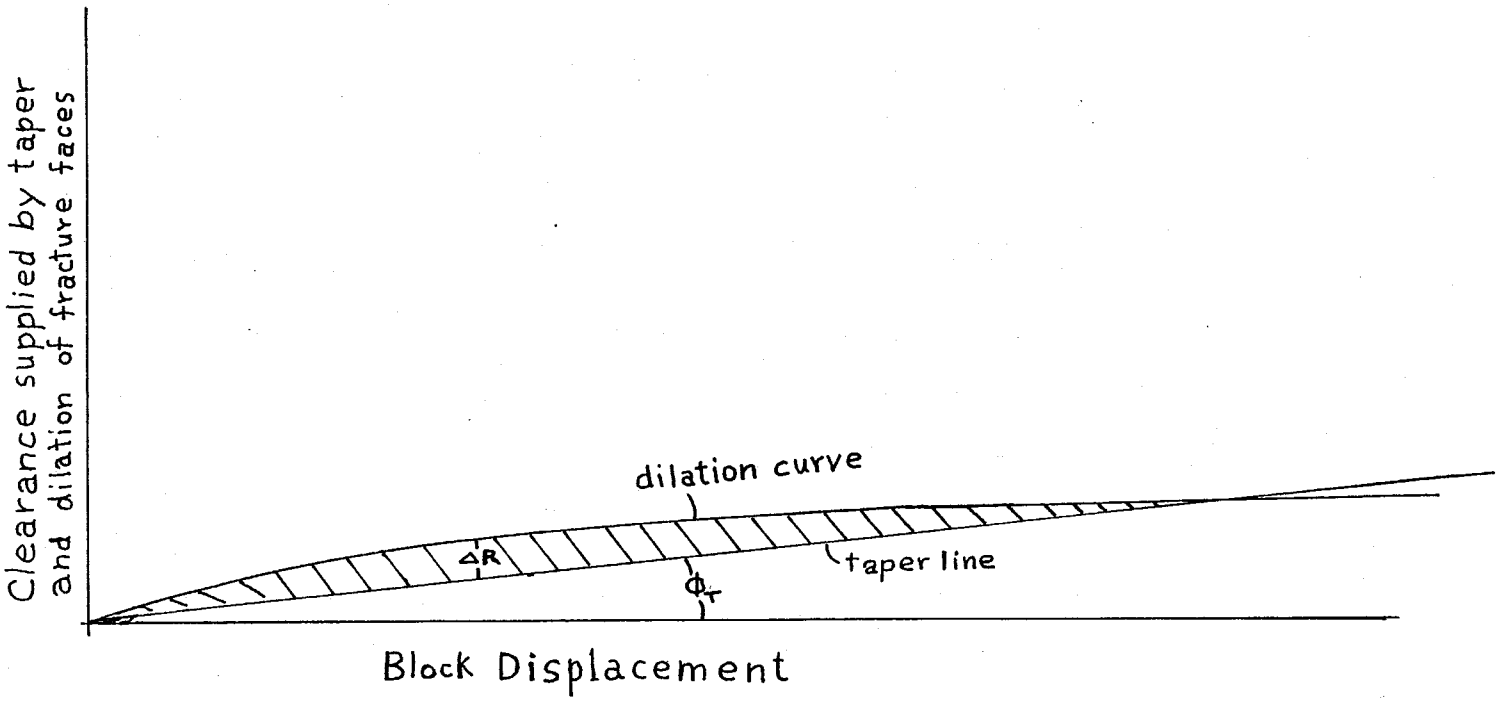
FIG. 5 shows the dilation of rough fracture surfaces when undergoing shear displacement, and clearance supplied by taper.

In FIG. 5 dilation vs. shear displacement is plotted for a hypothetical set of fracture faces. The clearance provided by displacement along a taper is also plotted as a straight line in FIG. 5. The enclosed area (cross hatched between the taper line and the dilation curve is the region where a component of dilation must be accomodated by radial compression of the block and expansion of the hole. This region will be termed the 'dilation hump'. The amplitude of the dilation hump is ΔR. The deformations to accomodate ΔR require an increase in radial stress $\Delta\sigma_R$. ΔR and $\Delta\sigma_R$ are related approximately by $$\Delta\sigma_R = E/D\ \Delta R \quad (7)$$

where $\Delta\sigma_R$ is the difference between the total raidal stress in 10 and the native horizontal stress. E is Young's modulus for the earth materials. D is the diameter of block and ΔR is the difference between the dilation of the fracture surfaces and the clearance provided by displacement along the taper. The maximum value of ΔR varies with the taper and the roughness of the fracture faces.

The radial stress component $\Delta\sigma_R$ can be divided into component, ΔP, due to the fluid pressure in separation 10 and the component, $\Delta\bar{\sigma}_R$, due to the contact stress between asperities. Then $$\Delta\sigma_R = \Delta P = \Delta\bar{\sigma}_R \quad (8)$$

The component, ΔP, is the difference between the fluid pressure in separation 10 and the native stress.

The component $\Delta\bar{\sigma}_R$ is responsible for frictional resistance to block movement. The average shear stress parallel to 10 due to friction is $$\tau_f = f\Delta\bar{\sigma}_R \quad (9)$$

where f is the coefficient of friction between dragging asperities.

Equations (8), (7), and (9) may be used to obtain $$\tau_f = f[E/D\Delta R - \Delta P] \quad (10)$$

It is evident from (10) that frictional resistance is decreased by increasing D or ΔP, or by decreasing ΔR, E or f.

In applications of the present invention some measure of control can be exerted over all of these factors, excepting E, in order to keep the breakout force smaller than the force available to move the block. The height of the dilation hump, ΔR, can be made small by making the taper, $\phi_t$, large enough.

However, large values of $\phi_t$ would require large volumes of high gel strength slurry to fill separation 10. Therefore, in practice $\phi_t$ should preferably be made as small as is consistent with reliable initiation of block movement. For this reason $\phi_t$ should usually be held less than 8°. The amplitude, ΔR, of the dilation hump can also be reduced by reducing the spacing between holes 22.

The pressure component, ΔP, increases in proportion to the gel strength of the slurry injected into 10, and frictional resistance in 10 is reduced directly with increases in ΔP. The friction coefficient, f, is reduced from the friction coefficient of bare rock surfaces by the formation of a thin boundary film of filter cake on the fracture faces in 10. A low friction film is formed from organic polymer fluid loss control agent contained in the gelled water initially injected. The resulting low shear strength boundary layer reduces friction between contacting asperities.

Equation (10) shows that the frictional resistance is decreased by increasing D, the diameter of 12. The relative influence of friction is also diminished by increasing D because net lift is proportional to the square of the diameter while the frictional resistance is proportional to the first power of the diameter.

Breakout with explosives: In a given operation, taper angles and various other factors just discussed are adjusted so that the frictional resistance during initial displacement does not exceed the net available lift force. The net force available for overcoming friction from injecting gelled fluid is given by equations (2) and (3). The net available lift forces as demonstrated by the specific case plotted in FIG. 3 can be extremely large. However, if necessary, much larger forces can be generated by combining gelled fluid injection with the detonation of explosive charges near the bottom center of 12. The following procedure allows efficient use of explosive energy to overcome the initial resistance to block movement.

Figure 6:
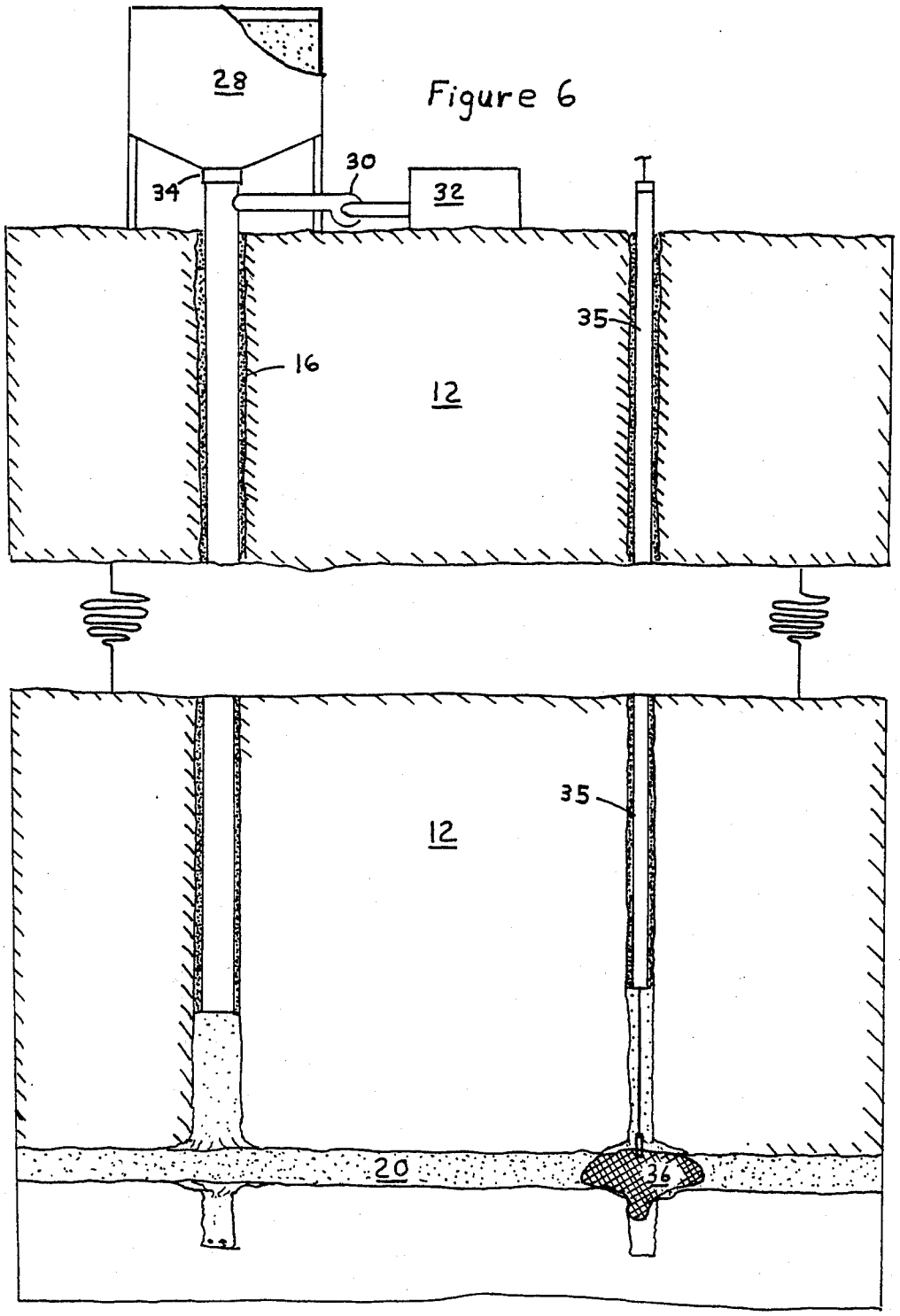
FIG. 6 is a cross sectional view of walls and equipment used with explosives to start block movement.

FIG. 6 illustrates a preferred arrangement for using explosives to help overcome the initial resistance to block movement. The slurry injection well 16 has a relatively large ID. Well 16 is lined with cemented casing and connected at the surface to elevated tank 28, pump 30, and slurry mixing equipment 32. The discharge passage joining 28 and 16 is equipped with a check valve 34 so that pressure can be built up inside 16.

A second well 35 is located near the center of 12 and spaced from 16 to reduce the peak pressure transmitted to 16 by the detonation. Well 35 is lined with a relatively small diameter heavy walled casing. The casing in 35 preferably does not extend to the bottom of 12.

Tank 28 is filled with slurry and pump 30 injects slurry into 20, building up the pressure to the maximum value that is practical and safe. Generally this pressure will be limited by the flow resistance of the gelled fluid in 10. The slurry pressure in 20 at this stage might, for example, be nearly twice the overburden pressure. Assuming the block resists continued movement by the maximum injection pressure, a charge of explosive slurry 36 is injected into the bottom of 35 and detonated while the injection pressure is maintained in 20. The energy of the explosive is efficiently transmitted to the piston like displacement of 12 over a short distance.

When explosives are used to help start the movement of 12, the drop in pressure which accompanies the shrinkage of the explosion gas bubble may threaten the stability in the roof of cavity 20. To protect the integrity of 20, the pressure within 20 should be prevented from falling below some minimum value. Excessively low pressure can be avoided by the following precautions. (1) Moving the block through the dilation hump in short increments by using several explosive charges of limited size. (2) Providing a volume of heavy slurry in 28 that can freely and rapidly flow by gravity into 20 as the gas bubble cools and contracts. (3) By employing an explosive which produces a substantial percentage of non condensable gas. Following the above procedure, slurry is injected to rebuild the pressure in 20 following each detonation until the block moves upward, unaided by explosives. The craters gformed in the roof and floor of 20 by detonation of charges 36 should not be a problem.

As the block moves upward the annular clearance increases because of the taper, and the drag resistance to block movement becomes negligible. In many cases it is preferable to taper 10 more steeply in the lower harder section, while forming 10 more nearly vertical in softer materials near the surface. This strategy reduces the volume and gel strength of slurry required to seal the annulus during displacement as shown in FIG. 2. The gel strength requirement is further reduced by compacting a ramp 21 against the sides of 12 as it rises above the surface.

If 12 is sufficiently large and is to be moved a substantial distance, it may be more economical to provide a plurality of injection wells 40, which slant into 10 so that the high density, high gel strength slurry can be injected directly into 10 at points spaced around the circumference. With this arrangement high gel strength slurry is injected directly into 10 as needed to maintain a seal. The main volume required to displace 12 can then be water containing a much smaller percentage of clay and other mineral solids for controlling leak off and stabilizing the roof and walls of 20.

Roof support by cavity pressure: Materials above the roof of cavity 20 may frequently be weak and highly fractured. Support of such materials by cavity pressure depends on maintaining a barrier to infiltration against the roof. To the extent that this barrier leaks, it may also be necessary to provide for drainage of filtrate from roof materials to reduce their pore pressure. When cavity 20 is filled with 'low leak-off' slurry under pressure a filter cake forms a permeability barrier on the roof, sealing fracture entrances as well as permeable rock surfaces.

To maintain the stability of incompetent roof rock the pore pressure in the roof materials must be substantially less than the cavity pressure. Maintenance of this condition may depend on the withdrawal of filtrate through drainage wells 42. To prevent a build up of pore pressure due to infiltration, wells 42 are drilled into the lower part of 12 without penetrating into 20 and are pumped out as needed to maintain adequate roof stability.

The roof support problem varies widely depending on application and the character of roof materials. In many applications the slurry in 20 is replaced by compressed air. With air filling 20. The filter cake is no longer inherently stable and self repairing. Therefore, roof support is not as reliable as when slurry fills the cavity. In some cases it may be worthwhile to upgrade the infiltration barrier at the roof of the cavity to provide more reliable protection when the cavity is air or gas filled. This can be accomplished by injecting a fluid into cavity 20 during block displacement capable of forming a superior protective film on the roof. Guar gum gelled water is an example of such a fluid. The volume of gelled water injected would be a small fraction of the cavity volume and have substantially lower density than the slurry injected into 20. Because of its lower density the gelled water would remain segregated as a thin layer against the roof, and deposit a much tougher more flexible and impervious filter cake than the filter cake formed by a slurry of mineral solids. Another method for improving the permeability barrier at the roof of the cavity is to inject a volume of water containing a dispersion of soft asphalt particles. Again, the water forms a layer at the roof of 20. The asphalt settles from water suspension against the roof and coalesces into a continuous impermeable film.

In applications where the objective is to form a storage cavity or to recover hydrocarbons by in situ processes, 12 will normally be cylindrical.

FIG. 2 could be an illustration of a cavity being prepared for the storage of liquids (ex. crude oil, LPG). The lower portion of 12 would then be composed of competent rock. An admixture of inhibited cement may be included with the high gel strength slurry pumped through wells 40 into 10 so that after block displacement has been completed 12 becomes cemented in place. In the final stages of block displacement a higher quality concrete can be injected into the lower part of 10. Special care should be taken in cementing the lower end of annular clearance 10 in order to support a stable roof.

To further improve the stability of 20, the roof can be made dome shaped by blasting down selected portions of the roof as shown in FIG. 7. A plurality of holes 42 could be used for placing the explosives. Clean out of debris and other preparations for the storage function of the cavity may then be performed through a large diameter shaft 43 bored into the cavity.

The cavity formed by displacement of 12 can provide the void space required for the creation of an underground retort chamber filled with fragmented oil shale for the in situ recovery of shale oil. After the block has been displaced and cemented in place, the slurry filling 20 is replaced by compressed air. Sufficient air pressure is maintained to provide temporary support for the roof of 20. Explosives are discharged in the oil shale adjacent 20.

The sequence is illustrated in FIG. 8. The left side of the section shown in FIG. 8 shows the left half of elevated and cemented block 12 and air filled cavity 20. Explosives are set in a plurality of holes 42. Explosives may also be set in holes 52 outside block 12. The right half of FIG. 8 shows the enlarged rubble filled cavity after detonation of the explosives.

The retort chamber filled with fragmented shale is connected to injection wells 42 and production wells 52. Air is injected into the top of the fragmented column through wells 42 and the top of the column is ignited. A combustion front passes downward through the column. Hydrocarbons are distilled from the shale and carried downward into the production wells 52 and to the surface.

Additional oil shale retorts can be produced by displacing additional blocks, while reusing the slurry used for block displacement.

The cavity formed by the displacement of 12 may be used as part of a process for recovering hydrocarbons from thick deeply buried coal seams. A fragmented cavity filled with coal would be created in a manner similar to that just described for oil shale. The slurry in 20 is replaced by compressed air. A plurality of explosive charges are then detonated within the coal, expanding a fragmented coal mass into 20. With the compressed air dispersed throughout the fragmented coal mass, its contained oxygen reacts quickly with the fragmented coal, raising its temperature.

Recovery of hydrocarbon from the fragmented coal filled cavity may be by gassification or liquification. For example, a gas may be produced by the reactions of the coal with injected air or oxygen and steam.

A high rate of resource recovery can be obtained by injecting hot hydrocarbon solvents into the coal and producing a slurry of liquified partially hydrogenated coal and undissolved coal fragments through production wells.

Cavity 20, formed by the elevation of 12, can be employed in a process to recover a valuable mineral from a thin roughly horizontal deposit 56. The present invention is especially applicable to a thin deposit of variable thickness (for example 0 to 1 meter thickness), wide areal extent, and in hard rock. The advantage in this application is that excavation of large volumes of rock with the mineral is avoided. A cross section through a thin mineral deposit being prepared for recovery is shown in FIG. 9.

The initial steps in the operation are as follows. The deposit is located by a grid of exploratory holes. These holes are later converted into injection holes 16 and separation holes 22. Separation holes 22 follow the perimeter of the selected area of recovery. A favorable stratigraphic feature to aid in controlling the basal fracture may be absent. In such cases all or most of the holes 22 and 16 are preferably notched and fractured for maximum control over the basal fractures 14.

Separation 10 may be formed at a rather large angle, $\phi_T$, (for example 10°) for easy release of block 12. Vertical block displacement in this application should normally be less then 2 meters. Consequently a large taper angle, $\phi_T$, does not create excessive clearance in separation 10.

If 12 is quite broad relative to its height, as in FIGS. 10 and 11, the injection of gelled slurry to elevate the block is preferably made through four or more wells 16 near the edges of the plate in addition to injection through a well 16 near the center. Then by monitoring changes in elevation at a number of stations on the surface of 12, and controlling the injection through each of the wells 16 in response to the elevation measurements, it should be possible to avoid bending and disrupting 12 as it is displaced upward.

The block is elevated enough to provide adequate clearance for conventional underground mining procedures. For example, if 12 is displaced 1.5 meters and the mineral zone averages 0.75 meters thickness, headroom in the mined out areas would then average 2.25 meters.

Roof support is provided by pumping concrete pillars into cavity 20. A procedure for injecting cylindrical pillars is illustrated in FIG. 11 and FIG. 12.

The injection pipe 58 is drawn upward from the bottom at velocity V as stiff concrete is injected at flow rate Q. The cross sectional area, A, of the column 60 is then given by $$A = Q/V$$

This method of pillar placement requires that the concrete have a high gel strength, and the density of the slurry filling 20 should not be too much less than the density of the concrete. The maximum height, h, of a stable uniform diameter pillar that can be deposited by this method is given approximately by $$h = |2\tau_c/(\rho_c - \rho_m)g| \quad (11)$$

where $\tau_c$ is the gel strength of the concrete, $\rho_c$ is the density of the concrete and $\rho_m$ is the density of slurry filling 20. For example, let $(\rho_c - \rho_m) = 100$ Kg/m$^3$ and $\tau_c = 1000$ Pa then h=2 meters.

Figure 13:
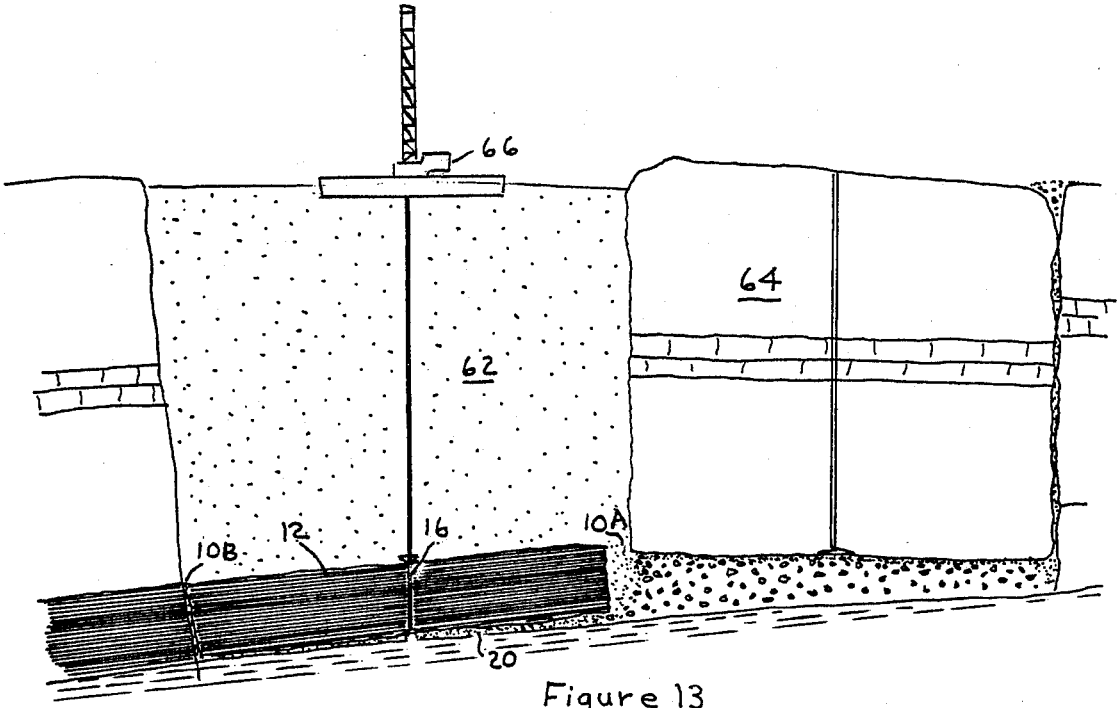
FIG. 13 shows injection of slurry by drill barge to release coal block from bottom of slurry filled pit.

FIG. 13 illustrates the application of the present invention where the block 12 is a coal bearing section at the bottom of a slurry filled pit. The pit 16 is created by an improved version of the mining process disclosed in U.S. Pat. No. 3,917,349. The pit is created by skidding a block 64 of overburden off the coal bed after providing a lubricant layer of injected clay paste. The block 64 is moved into an adjacent pit from which the coal has already been recovered by pumping slurry from the front face of the block to the rear, thus creating a driving force from the difference in fluid head.

After the overburden has been removed, block 12 is separated at its base by injection of gelled fluid. The drilling, fracturing, and injection operations may be performed by a drill barge 66 floating at the surface of the pit. This case differs from earlier examples in that the slurry filling pit 62 and separations 10 is more dense than 12 so than when 12 has been freed from bottom by fluid injection it begins to rise spontaneously to the surface of the pit where it may then be broken into smaller units and recovered. In this application of the process separation 10A is formed on one side of 12 by the removal of coal in the previous mining cycle, and 10A is relatively wide.

Figure 14:
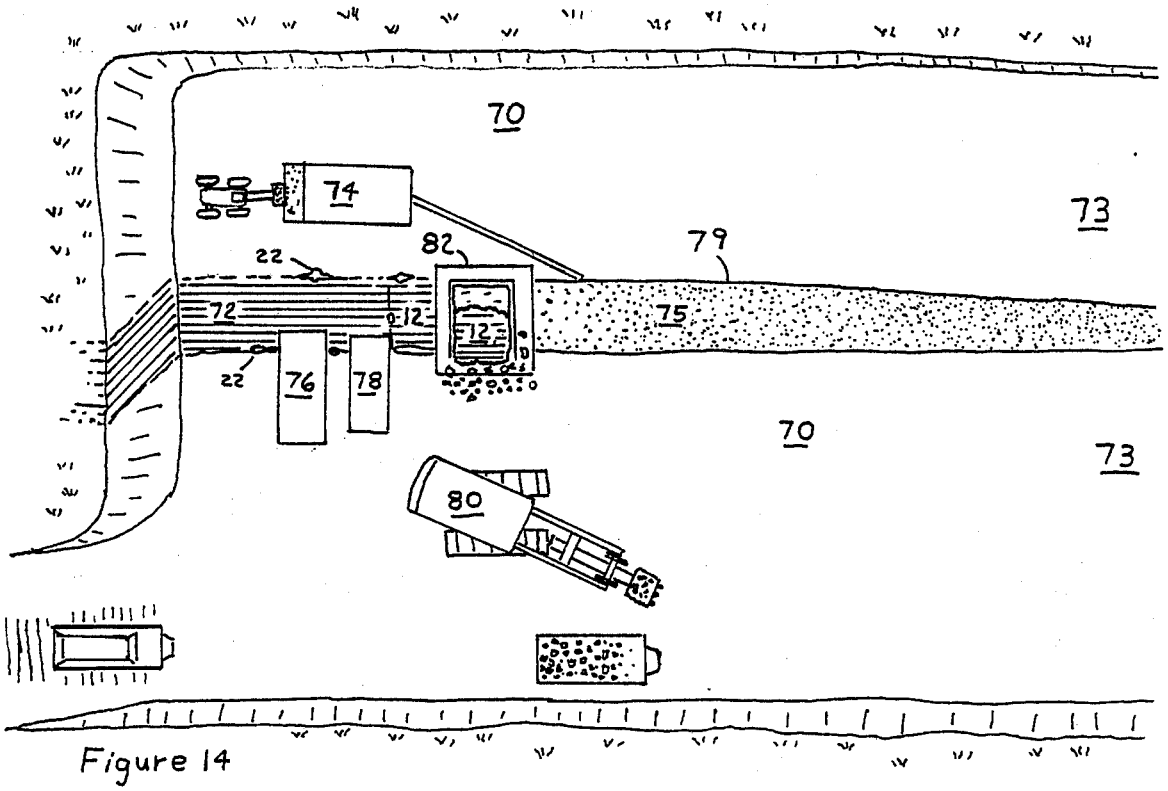
FIG. 14 is a plan view of a mine for recovering blocks of coal from a steeply dipping coal bed.
Figure 15:
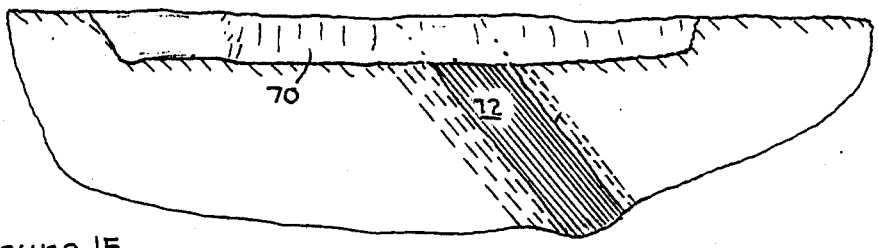
FIG. 15 is a cross section through the shallow mine pit and steeply dipping coal bed.

The present invention can be applied to the recovery of coal from steeply dipping beds. The dip of the bedding should preferably be greater than 40°. FIG. 14 shows a preferred mine plan for this application. The operation begins with the excavation of a shallow pit 70 to expose the outcrop of coal bed 72. A cross section of pit 70 is shown in FIG. 15. At the start an opening is mined or bored down the dip of the coal extending to the maximum planned recovery depth.

The initial opening is filled with slurry whose density exceeds the density of blocks 12. The first columnar block 12 is separated adjacent this initial opening, which provides clearance in the strike direction. After a block 12 is separated from surrounding materials it slides up dip impelled by hydrostatic slurry pressure until it protrudes far enough above the slurry to be at equilibrium. The block then continues moving up dip in small increments as coal is broken and loaded from the upper end.

A succession of coal blocks 12 are separated and recovered as the operation progresses along the strike. Shallow pit 70 is extended along the outcrop of 72. Top soil stripped ahead of 70 is deposited in reclaim area 73. Materials excavated to form 70 are converted into slurry by crushing and mixing means 74 and deposited in mined cavity 75. A succession of columnar coal blocks 12 are prepared by rotary drill 76 and kerf cutting means 78. A preferred method of block separation includes drilling down dip to the maximum recovery depth, extending notches from the drill holes by means of hydraulic jets in the desired planes of separation, and extending fractures from the notches by detonating slender explosive charges over the length of the fluid filled notched bore holes. Control over direction in drilling the holes 22 is essential. Various methods from the oil well drilling art may be used to monitor and control drilling direction. It is much preferred that the guidance technique be simple and require minimum interruption of drilling. A convenient technique for drill path guidance is outlined as follows. In conventional deep drilling a centralizing stabilizer placed at the top of a stand of drill collar about 30 m above the bit (the optimum distance depands on hole size, drill collar size, and weight on the bit) will cause an inclined bore hole to deviate toward vertical as it is advanced. The deviation toward vertical is caused by the so called 'pendulum effect'. Gravity acting on the span of drill collar supported off the low side of the hole between the bit and the stabilizer applies a force component to the bit toward vertical. Conversely, if a centralizing stabilizer is mounted a short distance above the bit, perhaps 2 m, the tendency is for the hole angle to increase. The drill collar leans against the low side of the hole above the stabilizer which acts as a fulcrum off-setting the bit toward the high side. The hole angle then increases progressively away from vertical as the bit advances. The two deviation effects just described can be varied and optimized by adjusting the stabilizer position according to the hole size, collar size, and weight on the bit.

In the present application the objective is to drill down dip with the bit holding a roughly fixed stratigraphic position relative to the coal. To accomplish this, advantage is taken of the contrasting drillabilities of coal and the various rock layers. Assume, for example, that the easily drilled coal is bounded above and below by moderately hard rock. A centralizing stabilizer is mounted a substantial distance above the bit and the hole is started down dip at the bottom of the coal bed. With the stabilizer above a stand of drill collar, the bit follows the bottom of the coal seam grazing the rock boundary because of its tendency to migrate toward the vertical. Conversely, if the stabilizer is mounted a short distance above the bit, the bit can be made to follow the dip along the top of the coal seam, grazing the upper rock boundary.

Frequently the rock immediately adjacent a coal bed is very soft shale or clay. If such soft boundary material is fairly thin and bounded in turn by harder rock the same techniques described above may be used to have the bit follow the soft rock layer adjacent to the coal while grazing the adjacent harder layer. In another application a resistant rock layer within the coal seam may be used to guide the drill which could follow either above or below the resistant layer. Details of the present mining method can be varied to take advantage of the particular rock layers associated with a given coal bed.

It is also important to control deviation of the hole away from the dip direction within the plane of the bedding. One method employs a jet bit with one nozzle extended close to bottom. The hole is surveyed and the bit is oriented by techniques well known in the drilling art. With the extended nozzle on the side toward which the correction is to be made, the drilling fluid is circulated to erode the bottom of the hole in this direction.

There are many arrangements of drill holes, eroded notches, kerfs, and fractures that might be used to form separations 10 to free the columnar block 12. The particular combination of operations chosen depends on the combination of rock strata associated with the coal and the kerf cutting method available. An example arrangement of separations 10 is shown in FIG. 16.

Figure 17:
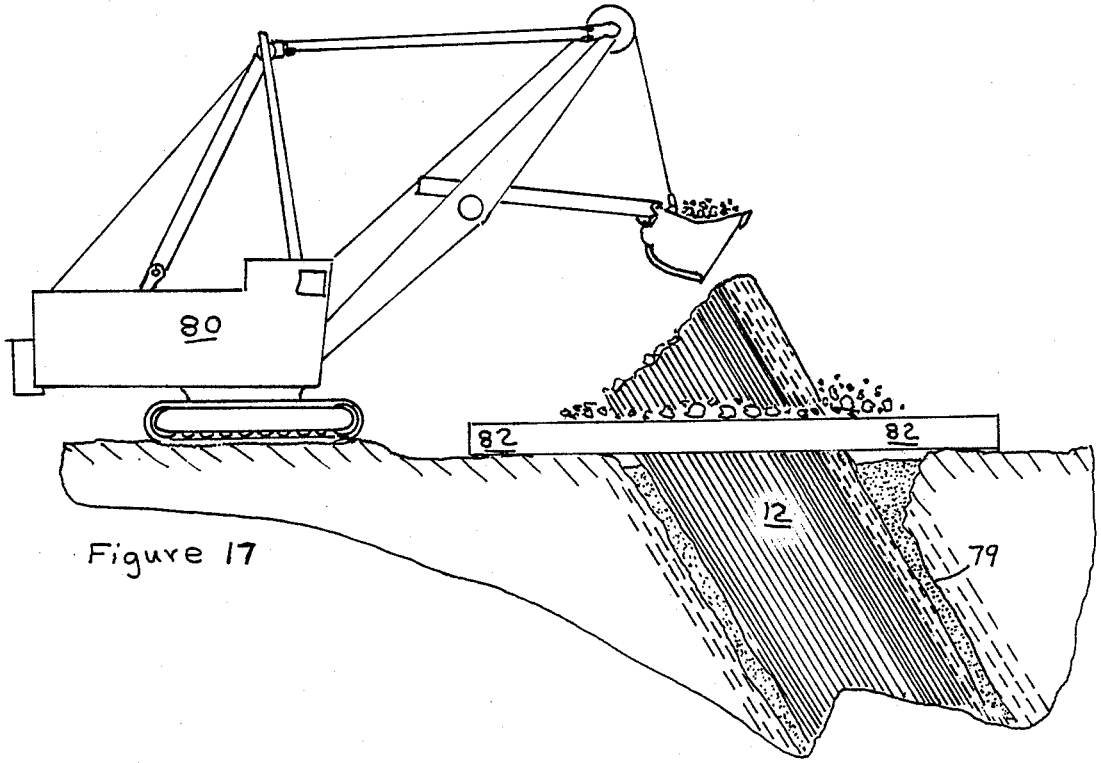
FIG. 17 shows excavation by power shovel from the top of the rising coal block.

Separations 10B and 10C are formed parallel to the bedding. 10B is an open kerf cut by hydraulic jetting in an easily eroded bed to provide clearance for block movement. 10C is formed by extending fractures along the bedding from notched pilot hole 22C. Separation 10D is formed by hydraulically notching and extending fractures perpendicular to the bedding. The fractures are extended from holes 22C and 22D by detonating a slender explosive charge (for example heavy gage detonating cord) extended over the lengths of the holes which are filled with water containing fluid loss control agent. Hole 22C is preferably drilled so as to converge with the coal top so that 12 tapers on its width normal to the bedding as shown in FIG. 17.

Figure 16:
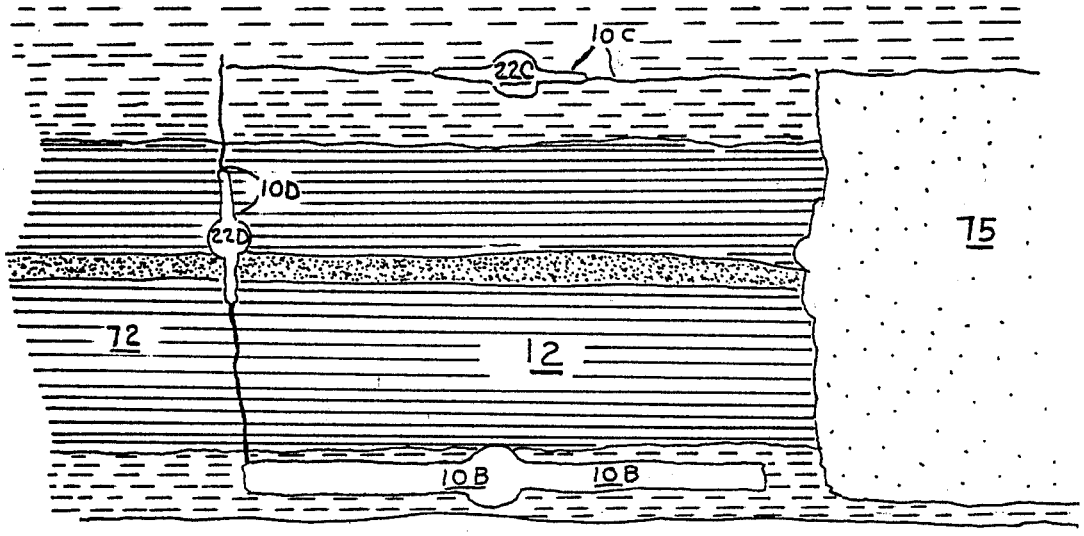
FIG. 16 is a cross section taken perpendicular to the dip of the coal bed showing preparation of coal block for release.

The kerf cutting operation may leave narrow connections between 12 and adjacent materials as shown in FIG. 16. To complete the separation of 12, holes 22C and 22D may be injected with high density gelled slurry to effect a small lateral displacement of 12, thus destroying the residual interconnections and forcing slurry into separations 10C and 10D. Slender explosive charges extended the lengths of the holes may also be used in this operation. At the same time small explosive charges at the bottom of 22C and 22D can be detonated so as to propagate fractures from notches across the lower end of 12.

With separation completed, block 12 slides upward and the protruding upper end is broken and loaded. To keep the upper end of 12 feeding above slurry level so that it can be conveniently loaded, the slurry density should be substantially greater than block density. To meet this requirement the slurry density is preferably in the range 1500 kg/m$^3$ to 2050 kg/m$^3$, depending on the amount of rock contained in 12. Slurry filling 75 must also be dense enough to support 'hanging wall' 79, that is the upper side of 75. The density required for hanging wall stability increases as the dip angle decreases and may become controlling for dips less than 50°. For example, if the dip is 35°, the density required for hanging wall stability may be about 1900 kg/m$^3$. The position of the water table in the hanging wall block is also important to its stability. If the water table is close to the surface the slurry density requirement is greater. Therefore, in cases where stability is in question, the hanging wall side of 70 should be provided with good drainage and possibly drainage wells to reduce ground water pressure.

The slurry pressure against hanging wall 79 is normally less than the native stress normal to the coal bed. Wall 79 will, therefore, sag with increasing distance behind the coal face as shown in FIG. 14. The total amount of subsidence can be minimized by using slurry with adequate density supplemented in some cases by depositing compact fill in cavity 75. Subsidence can generally be controlled as much as is needed to prevent damage to near-by structures on the hanging wall block by these measures.

The coal can be broken and loaded as it emerges at the surface by a wide variety of conventional methods. One method is illustrated in FIG. 17. A power shovel 80 digs coal from the upper end of block 12 as it moves upward incrementally. A floor structure 82, assembled from movable sections, surrounds the emerging end of 12. Floor 82 catches coal spilling from the end of the column. Coal inaccessible to 80 can be picked up by a wheel loader. Floor structure 82 may include below deck devices (scrapers, brushes, spray heads) for removing mud and shale from 12 as it emerges.

Figure 18:
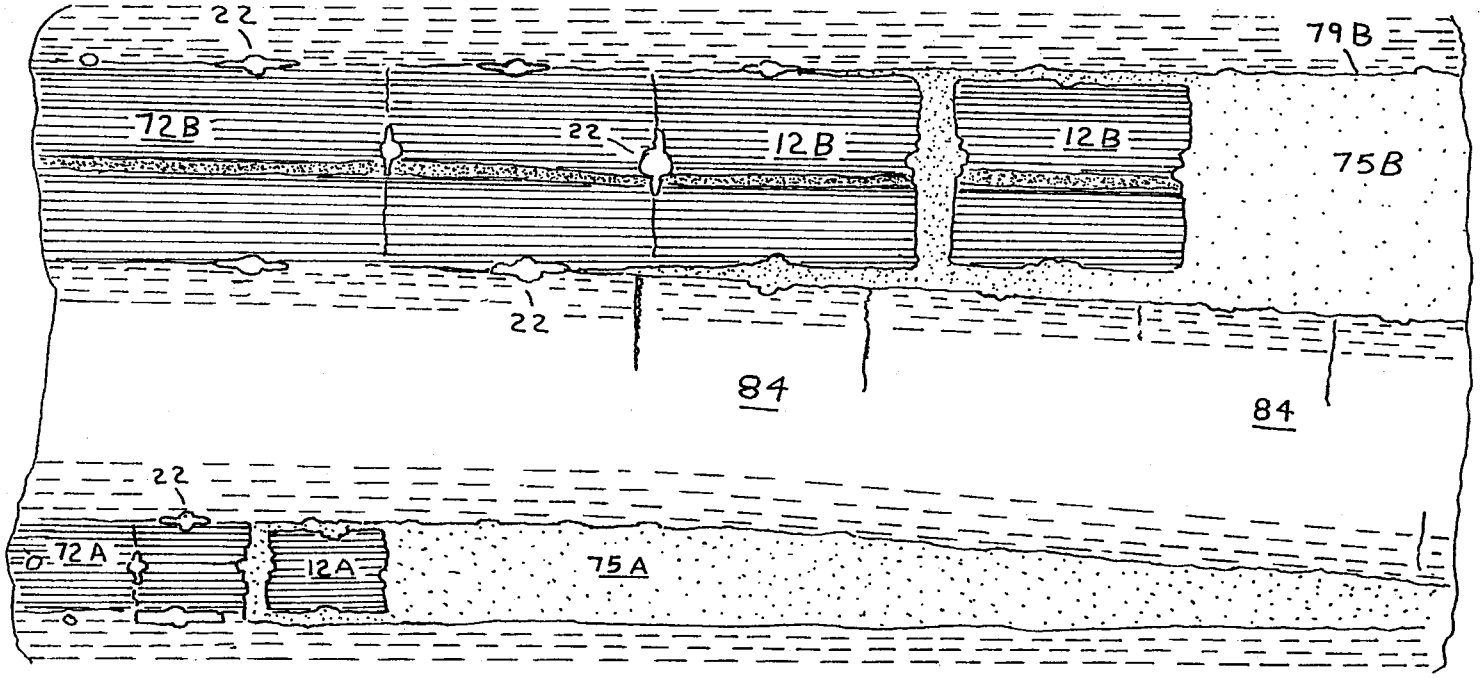
FIG. 18 is a cross section taken perpendicular to the dip showing how recovery from one coal bed can provide clearance to aid recovery of an adjacent coal bed.

Multibed Recovery: FIG. 18 illustrates a system for recovering two beds of coal. The lower bed 72A is recovered along the strike ahead of bed 72B, the upper bed. The mud density in pit 75B is sufficient to hold the rate of convergence of hanging wall 79B to a small value. A difference in mud level, and possibly, a differnce in mud density, is maintained between the two pits 75A and 75B such that rock layer 84 between the two coal beds sags toward pit 75A. If the mud densities in the pits are equal, the distributed load, $\Delta P$, tending to warp 84 toward pit 75A is the sum of a gravitational load component and a mud pressure difference due to the difference in mud levels, $\Delta h$, is $$\Delta P = \Delta h \rho_m g + \cos \alpha (\rho_r - \rho_m) g \quad (12)$$

The mud level difference is positive when the mud level in 75A lies below the mud level in pit 75B. The magnitude of $\Delta P$ can be regulated by regulating $\Delta h$ so that 84 sags gradually toward 75A without catastrophic failure. Fill may be placed in 75A to limit the displacement of 84. The displacement of 84 provides a large clearance normal to the bedding of bed 72B so that it is unnecessary to cut slots for the recovery of 72B. Coal 72A may be recovered by methods other than the present invention, such as bore hole mining. The recovery depth for 72A must be substantially greater than the recovery depth for 72B. For example 300 m depth for 72A and 275 m depth for 72B.

Removal of 72A creates an altered stress field advancing along the strike. The drilling, notching, and fracturing for the preparation of blocks 12B from bed 72B take place in the transition region of this stress field where the compressive stress normal to the bedding gradually changes from the native stress to a reduced level equal to, or somewhat less than, the mud pressure in 75A. Holes 22 on the lower side of bed 72B are preferably drilled, notched, and fractured while still within this transition region.

A procedure similar to the above may be applied to the recovery of more than two beds and to cases where the rock layer between beds is flexed upward rather than downward. In this last case larger mud level differences are required. The dual and multicoal bed methods are most applicable to cases where the beds dip very steeply, i.e. $\alpha > 60°$, because with steeper dip there is wider latitude in adjusting mud levels and densities between two cavities 80 to control the sag of the interburden between two coal beds.

It is apparent from the examples of the present invention described above that many other examples might have been given within the scope and spirit of the invention as described in the specification and appended claims.

I claim:

1. A method for displacing a very large block of earth materials over substantial vertical distances which comprises:

delineating said block on lateral sides by fracturing and (or) cutting lateral separations, where the lateral sides may range from 35° to 90° inclination, and where opposite lateral sides of said block are either roughly parallel of moderately convergent downward;

filling said lateral separations with a gelled slurry whose density exceeds 1600 kg/m$^3$ for the major portion of the displacement, where the slurry is composed principally of water and locally excavated solids in a broad size range including clay, silt, and sand; and causing substantial upward displacement of the block by feeding pressurized fluid to the underside of the block.

2. The method of claim 1 where materials are excavated from the upper surface of the block, and where a portion of these materials are mixed with water to form a slurry and the slurry is fed into the void formed by block displacements.

3. The method of claim 1 where a rectangular block containing more than 25% coal by volume is separated from adjacent sediments at the bottom of a slurry filled pit where the lateral separation on at least one side of the coal containing block is formed by the earlier recovery of a coal containing block which was located in an adjacent area, where the initial upward displacement of the block is effected by injection of slurry into bedding plane hydraulic fractures separating the underside of the block;

where the slurry filling the pit and lateral separations is more dense than the average density of the block so that after the block has been elevated a short distance by slurry injection it rises spontaneously to the surface by positive buoyancy.

4. The method of claim 1 where said lateral separations are formed by explosive induced fractures, propagated between longitudinally notched drill holes, where the holes angle at least slightly inward so as to define a tapered block, where the holes are filled with water containing fluid loss control agent before fracturing.

5. The method of claim 4 where the initiation of block movement is aided by discharging explosive under or adjacent the lower end of the block.

6. The method of claim 1 where the lower end of the block is separated from materials below by extending at least one notch from a bore hole roughly perpendicular to the intended direction of block displacement where at least one fracture is extended from the bore hole notches by water injection where the injected water is converted progressively into a slurry of increasing gel strength by additions of clay, silt, and sand, where injection continues with slurry of high gel strength until the block begins moving upward.

7. The method of claim 1 where slurry is injected into the underside of the block under a pressure substantially exceeding the hydrostatic column pressure of the slurry filling the lateral separations, where the density of slurry filling the lateral separation exceeds 1800 kg/m$^3$ for more than 50% of the block displacement, where the gel strength of slurry filling the side clearance exceeds 75 Pa for more than 50% of the block displacement, and where the block is displaced in a substantially vertical direction.

8. The method of claim 7 where earth materials are excavated from the top of the block and a major portion of these materials are compacted against the sides of the block as it projects above the original ground surface.

9. The method of claim 7 where the initial block displacement is initiated by combining gelled slurry injection with the detonation of one or more explosive charges located in the bottom center region of the block.

10. The method of claim 7 where earth materials are excavated from the top of the block as it becomes elevated and a portion of these materials are used to manufacture the slurry injected into the underside of the block.

11. The method of claim 10 where the block is rectangular and contains a section of coal at the bottom; where removal of material from the top of the block, mixing of slurry, and feeding of slurry into the underside of the block continues until the block has been reduced to said coal section floating at the surface of a slurry filled rectangular pit.

12. The method of claim 7 where more than half the lateral separation area is created by fracturing between drill holes.

13. The method of claim 12 where at least the lower half of the block tapers downward with the included angles between opposite sides greater than 6°.

14. The method of claim 7 where the block is roughly cylindrical.

15. The method of claim 14 where at least the lower portion of the block consists of competent rock and the cavity is provided with lining and roof support as may be needed for its use in the storage of liquids or gasses.

16. The method of claim 7 where slurry containing cement is injected into the lower portion of the lateral separation so that the block becomes cemented in place after its displacement has been completed.

17. The method of claim 16 where the lower portion of the block consists of oil shale:

where the slurry filling the cavity beneath the elevated block is replaced by compressed air;

where explosives are used to fragment the oil shale adjacent said cavity to form an enlarged cavity filled with fragmented oil shale; and where said enlarged rubble filled cavity is connected to injection and production wells and other equipment needed for the operation of an in situ shale oil retorting process.

18. The method of claim 7 where the lower end of the block contains a coal bearing section;

where slurry is displaced from the cavity by compressed air; and where the coal is fragmented into the cavity by explosives.

19. The method of claim 18 where the cavity filled with fragmented coal is suitably connected to injection and production wells and other equipment for the operation of an in situ coal gasification process.

20. The method of claim 18 where the cavity is suitably connected to injection and production wells and other equipment, and where solvents are injected to partially dissolve the coal and where a slurry of liquified coal and coal fragments is recovered through production wells.

21. The method of claim 7 where a thin vein of valuable mineral is located in or immediately below the under side of the block where columnar supports are provided for the roof of the cavity;

where the slurry filling the cavity is replaced by air; and where the valuable mineral is mined from the cavity.

22. The method of claim 1 where the long axis of said block is a rectangular column which follows the dip of a coal section where the dip is greater than 35°;

where the block contains more than 30% coal by volume;

where the block has four sides roughly parallel to its long axis;

where two of the four sides are roughly parallel to the bedding;

where two of the four sides are roughly perpendicular to the bedding;

where the pressure of fluid entering under the downward end of the columnar block displaces it upward along the dip; and where coal is broken and loaded from the upward end of the columnar block emerging at the surface.

23. The method of claim 22 where the lateral separations are formed in substantial part by rotary drilling down dip parallel to the bedding, by cutting longitudinal notches in the holes and by discharging linear explosive charges in one or more of the longitudinally notched holes.

24. The method of claim 22 where the separation of the lower end of the column is formed by discharging explosives in one or more fluid filled hydraulically notched holes where the notches are oriented to induce fractures across the lower end of the block.

25. The method of claim 22 where the lateral separations are formed so that the block tapers in the downward direction in its width measured perpendicular to the bedding.

26. The method of claim 22 where at least one of the separations parallel to the bedding is formed by a kerf cutting process.

27. The method of claim 22 where one of the sides perpendicular to the bedding faces a slurry filled cavity formed by the removal of previous blocks;

where the density of slurry filling the cavity exceeds the density of the block;

where the block is separated and slides spontaneously up dip by positive buoyancy; and where the mining operation is a cyclic process which advances in the strike direction as a succession of blocks are displaced up dip, broken and recovered.

28. A method in accordance with claim 27 where a second seam of coal, separated from the first seam by a substantial thickness of rock, is recovered as a series of columnar coal bed segments located in the strike direction behind the coal face of the first bed, and where the difference in hydrostatic pressure is maintained between the two mined cavities such that a gradual sag of the intervening rock layer occurs toward the mined cavity of the first bed, thus providing clearance normal to the second coal bed aiding its removal.

* * * * *

UNITED STATES PATENT AND TRADEMARK OFFICE

CERTIFICATE OF CORRECTION

PATENT NO. : 4,230,368
DATED : October 28, 1980
INVENTOR(S) : James M. Cleary, Jr.

It is certified that error appears in the above—identified patent and that said Letters Patent is hereby corrected as shown below:

Columns 5 and 6 equations (3.1), (3.2), (3.3) and (3.4), the symbol $\eta$ should be the Greek letter pi ---- $\pi$ - - .

Column 5 equation (3.1) the expression "$\eta D^2 4 [\Delta P_1/3]$"

should be $-[\pi D^2/4][\Delta P_1/3]$ - - .

Column 7 equation (6) the second equal sign " = " should be --- + ---.

Column 8 equation (7) expression "$E/D\Delta R$"

should be $- - [E/D]\Delta R$

Column 8 equation (8) the second equal sign " =" should be --- + ---.

Column 8 equation (10) the expression "$E/D\Delta R$"

should be $-- (E/D)\Delta R --$

Signed and Sealed this

Seventeenth Day of March 1981

[SEAL]

Attest:

RENE D. TEGTMEYER

Attesting Officer

Acting Commissioner of Patents and Trademarks